US006054419A

United States Patent [19]

Le Coent

[11] Patent Number: 6,054,419

[45] Date of Patent: Apr. 25, 2000

[54] MIXTURE OF ALKYL-ARYL-SULFONATES OF ALKALINE EARTH METALS, ITS APPLICATION AS AN ADDITIVE FOR LUBRICATING OIL, AND METHODS OF PREPARATION

[75] Inventor: Jean-Louis Le Coent, Le Havre, France

[73] Assignee: Chevron Chemical Company LLC, San Francisco, Calif.

[21] Appl. No.: 09/087,106

[22] Filed: May 29, 1998

[51] Int. Cl.[7] ..... C10M 159/24

[52] U.S. Cl. ..... 508/391; 508/398

[58] Field of Search ..... 508/391, 398

[56] References Cited

U.S. PATENT DOCUMENTS

| | | | |
|---|---|---|---|
| 5,071,576 | 12/1991 | Vernet et al. | 508/398 |
| 5,112,506 | 5/1992 | Marsh et al. | 508/391 |
| 5,137,648 | 8/1992 | Marsh et al. | 508/391 |
| 5,578,235 | 11/1996 | Jao et al. | 508/391 |
| 5,792,732 | 8/1998 | Jao | 508/391 |

*Primary Examiner*—Jacqueline V. Howard
*Attorney, Agent, or Firm*—Ernest A. Schaal

[57] ABSTRACT

Mixture of alkyl aryl sulfonates of superalkalinized alkaline earth metals comprising:

(a) 50 to 85% by weight of a mono alkyl phenyl sulfonate with a $C_{14}$ to $C_{40}$ linear chain wherein the molar proportion of phenyl sulfonate substituent in position 1 or 2 is between 0 and 13%, and (b) 15 to 50% by weight of a heavy alkyl aryl sulfonate, wherein the aryl radical is phenyl or not, and the alkyl chains are either two linear alkyl chains with a total number of carbon atoms of 16 to 40, or one or a plurality of branched alkyl chains with on average a total number of carbon atoms of 15 to 48.

Inasmuch as these mixtures contain less than 10% of linear mono alkyl phenyl sulfonate substituted in position 1 or 2 of the linear alkyl chain, they exhibit properties making them fit for use as detergent/dispersant additives for lubricating oils.

14 Claims, No Drawings

MIXTURE OF ALKYL-ARYL-SULFONATES OF ALKALINE EARTH METALS, ITS APPLICATION AS AN ADDITIVE FOR LUBRICATING OIL, AND METHODS OF PREPARATION

This application is related to PCT/FR97/01551, filed Sep. 3, 1997.

The present invention relates to a mixture of alkyl aryl sulfonates of superalkalinized alkaline earth metals, its application as detergent/dispersant additives for lubricating oils, and methods for preparing said mixture.

BACKGROUND OF THE INVENTION

In prior art, methods are known for preparing weakly or strongly superalkalinized sulfonates from sulfonic acids obtained by the sulfonation of different alkyl aryl hydrocarbons and from an excess of alkaline earth base.

The alkyl aryl hydrocarbons subjected to the sulfonation reaction are obtained by alkylation via the Friedel and Craft reaction of different aryl hydrocarbons, particularly aromatic, with two different types of olefin:

branched olefins obtained by the oligo-polymerization of propylene to $C_{15}$ to $C_{42}$ hydrocarbons, particularly the propylene tetrapolymer dimerized to a $C_{24}$ olefin, and linear olefins obtained by the oligo-polymerization of ethylene to $C_{14}$ to $C_{40}$ hydrocarbons.

While it is easy to obtain a good dispersion in the medium of the alkaline earth base not fixed in the form of salt if the sulfonic acid is derived from a hydrocarbon obtained by alkylation of an aryl hydrocarbon with a branched olefin, it is difficult if the alkylation is effected with a linear olefin. It is particularly difficult for the alkylation of an aryl hydrocarbon containing at least 80 mole % of linear mono alpha olefin, due to the formation of a skin in the open air.

This poor dispersion is especially pronounced if the medium also contains a high proportion of sulfonate, that is if it corresponds, according to Standard ASTM D-2.896, to a low base No. BN (between 3 and 60), hence to a low content of free lime and the absence of carbon dioxide and carbonate.

In fact, during the alkylation reaction with benzene or another aromatic or aryl hydrocarbon, the molar proportion of the corresponding cyclic hydrocarbon group in position 1 or 2 of the initial linear olefinic chain is about 25%.

When prepared by the method described, for example in French Patent No. 2,564,830, this high proportion of alkyl aryl hydrocarbon having an aryl radical in position 1 or 2 of the linear alkyl chain results in a sulfonate that exhibits hygroscopic properties such that a superficial 'skin' is formed. This 'skin' makes this product unacceptable as an additive for lubricating oil.

Furthermore, the formation of this superficial skin is generally accompanied by a very low filtration rate, a high viscosity, a low incorporation of calcium, a deterioration of anti-rust performance, and an undesirable turbid appearance, or even sedimentation, when the sulfonate thus prepared is added at the rate of 10% by weight to a standard lubricating oil and stored for examination.

The Applicant has carried out chromatographic analyses to identify each of the different isomers differing by the position of the aryl radical on the carbon atom of the linear alkyl chain, and examined their respective influence on the properties of the corresponding alkyl aryl sulfonates of alkaline earth metals obtained from these different isomers.

The Applicant has thus discovered that he could overcome the aforementioned drawbacks, inasmuch as the molar proportion of aryl hydrocarbon, other than benzene, fixed to the carbon atoms situated in position 1 or 2 of the linear alkyl chain was between 0 and 13%, and preferably between 5 and 11%, and more particularly between 7 and 10%.

This discovery was the subject of a French Patent Application filed Mar. 8, 1995 under No. 95 02,709 by the Applicant.

Yet the Applicant had not succeeded in obtaining satisfactory results when the aryl hydrocarbon was benzene, because, heretofore, he had never been able to prevent the formation of the skin with the use of this aromatic hydrocarbon, even if said hydrocarbon was alkylated with a very long chain linear mono olefin on the carbon atom situated in position 1 or 2 of said chain in a molar proportion of between 0 and 13%, and preferably between 5 and and more particularly between 7 and 10%.

SUMMARY OF THE INVENTION

The Applicant has now discovered that the aforementioned drawbacks could be overcome by using a mixture of alkyl aryl sulfonates of superalkalinized alkaline earth metals comprising:

(a) at least 50% and not more than 85% by weight of a mono alkyl phenyl sulfonate in which the mono alkyl substituent is a linear chain, containing between 14 and 40 carbon atoms, and the phenyl sulfonate radical of the alkaline earth metal is fixed, in a molar proportion of between 0 and 13%, preferably between 5 and 11%, and more particularly between 7 and 10%, in position 1 or 2 of the linear alkyl chain, and (b) at least 15% and not more than 50% by weight of a heavy alkyl aryl sulfonate selected from:

(i) the dialkyl aryl sulfonates wherein the aryl radical may be a phenyl radical substituted or not, such as in particular the phenyl, tolyl, xylyl, ethyl phenyl and cumenyl radicals, and wherein the two alkyl substituents are both linear alkyl chains, of which the sum of the carbon atoms is between 16 and 40, and preferably between 18 and 40 carbon atoms, or (ii) the mono or poly alkyl aryl sulfonates wherein the aryl radical may be a phenyl radical substituted or not, such as in particular the phenyl, tolyl, xylyl, ethyl phenyl and cumenyl radicals, and wherein the alkyl substituent or substituents are branched chains, wherein the sum of the carbon atoms is on average between at least 15 and up to 48 carbon atoms.

Said mixture of alkyl aryl sulfonates having a maximum molar content of 10%, and preferably not more than 8% of linear mono alkyl phenyl sulfonate, wherein the phenyl sulfonate radical is substituted in position 1 or 2 of the linear alkyl chain.

The mixtures of the invention preferably contain between 75 and 85% by weight of mono alkyl phenyl sulfonate, as defined in (a) above and between 15 and 25% by weight of heavy alkyl aryl sulfonate as defined in (b)(i) or (b)(ii) above with, for the mixture, the same maximum content of mono alkyl sulfonate substituted in position 1 or 2.

In fact, said mixtures exhibit a set of properties of solubility in the lubricating oil, filtration rate, viscosity, dispersion of impurities (carbonaceous particles), incorporation of alkaline earth metal in the medium, anti-rust properties, an absence of turbidity, and an absence or delay of the formation of a superficial skin, which makes them particularly attractive as detergent/dispersant additives in this type of oil.

This result is especially surprising since the use of a (linear) mono alkyl phenyl sulfonate, as defined in (a) above, that is, obtained by alkylation of benzene with a linear olefin containing at least 80 mole % of linear mono alpha olefin, having a low base No. BN (that is between 3 and 60), had never heretofore been used to obtain the set of properties necessary for their use as detergent/dispersant additives for lubricating oils.

DETAILED DESCRIPTION OF THE INVENTION

The Applicant has discovered that mixtures of alkyl aryl sulfonates according to the present invention were not subject to the formation of a superficial skin, during storage at ambient temperature, if their molar content of mono alkyl phenyl sulfonate wherein the phenyl sulfonate substituent substituted in position 1 or 2 on the linear alkyl radical is lower than 10% and preferably equal to or less than 8%.

The limit of 10% is the threshold above which the formation of a skin appears within a period of less than 48 h after storage, making the mixture difficult to use as an additive for lubricants.

By contrast, the maximum limit of 8% corresponds to mixtures for which the formation of a superficial skin only occurs after a storage time of a plurality of days, indeed one or a plurality of weeks, making them suitable as detergents/dispersants for lubricating oils.

Without wishing to be bound by any specific scientific explanation, the Applicant assumes that the presence of a phenyl sulfonate substituent in position 1 or 2 of a linear alkyl group absorbs the water in particular, and this water absorption brings about the undesirable formation of a superficial skin during storage of the mixture containing it in the open air.

MONO ALKYL PHENYL SULFONATE

The first of the two ingredients in the composition of the mixtures which are the object of the present invention, in a preponderant proportion with respect to the second, is a mono alkyl phenyl sulfonate, wherein the linear mono alkyl substituent, derived from a linear olefin, as previously defined, must be substituted by the phenyl sulfonate radical in a certain proportion in position 1 or 2 of the linear alkyl chain.

The content of 13% is the threshold above which it is no longer possible to obtain an ingredient that can be used to obtain a mixture exhibiting a suitable improvement of the different properties listed hereinabove.

The content of 11% is the upper limit of the ingredient prepared on the industrial scale, and for which an attempt is made to obtain a mixture exhibiting all of the aforementioned properties.

And the content of 10% is the value desired for the industrial production of the additive used in the composition of the mixture that is the object of the present invention.

Without wishing to be bound by any particular scientific explanation, it is assumed that the more the phenyl radical is fixed to a carbon atom situated in a position far from the ends of the hydrocarbon chain of the linear olefin, the more pronounced is the hydrophobic character of the corresponding alkyl phenyl hydrocarbon, thereby bringing about the good properties of the mixtures of alkyl phenyl sulfonates of the invention.

However, the hydrophobic character of this alkyl phenyl hydrocarbon is not sufficient to confer to the corresponding sulfonate properties making it suitable as a detergent/dispersant additive for lubricating oil.

To achieve this, it is in fact necessary to add to it, according to the invention, another heavy alkyl aryl sulfonate in a minimum proportion of 15% and a maximum proportion of 50%, and preferably between 15 and 25% by weight, with respect to the mixture of sulfonates.

HEAVY ALKYL ARYL SULFONATE

As described hereinabove, this heavy alkyl aryl sulfonate can be of two types.

DIALKYL ARYL SULFONATES

It can be a dialkyl aryl sulfonate, wherein the aryl radical is a phenyl radical that is substituted or not, such as in particular the phenyl, tolyl, xylyl, ethyl phenyl or cumenyl, and wherein each of the two alkyl groups is derived from a linear olefin which can contain at least 80 mol % of linear mono alpha olefin and the sum of the carbon atoms in these two linear alkyl groups is between 16 and 40, and preferably between 18 and 40 carbon atoms.

These heavy dialkyl aryl sulfonates can be obtained in a plurality of ways.

A first multi-step method consists in first effecting the synthesis of the corresponding mono alkyl aryl hydrocarbon wherein the linear mono alkyl radical has the shortest chain length of carbon atoms, followed by the alkylation of this hydrocarbon by a linear olefin containing at least a number of carbon atoms which is sufficient to satisfy the ranges indicated hereinabove.

A second method consists of a direct alkylation of an aromatic carbide by a mixture of linear alpha olefins from $C_8$ to $C_{40}$ in an aromatic carbide/olefin mole ratio close to 0.5, in order to obtain a dialkyl aryl hydrocarbon wherein the sum of the carbon atoms of the two linear alkyl chains satisfies the aforementioned definition.

The heavy dialkyl phenyl sulfonates can also be products marketed under the name of 'LAB Bottoms': these are heavy by-products obtained in the production of $C_{12}$ linear alkyl benzenes, routinely used in household detergents after sulfonation and caustic neutralization. During its production, the $C_{12}$ linear alkyl benzene is separated by distillation, and the heavy fraction, called 'LAB Bottoms', mainly consists of dialkyl benzenes substituted in the para and meta positions and, in a smaller proportion, of certain heavy mono alkyl benzenes, resulting from the oligo-polymerization of the initial linear olefin.

MONO OR POLY ALKYL ARYL SULFONATES

The other type of heavy alkyl aryl sulfonate used in the mixtures of the invention is a mono or poly alkyl aryl sulfonate, wherein the alkyl substituent or substituents are no longer, as in the aforementioned ingredients, a linear chain, that is derived from the oligo-polymerization of ethylene, but branched chains, that is derived from the oligo-polymerization of propylene, and wherein the sum of the carbon atoms is on average at least 15 and up to 48 carbon atoms.

These branched heavy mono or poly alkyl aryl sulfonates can be obtained by the alkylation of an aromatic hydrocarbon by a heavy hydrocarbon from propylene, on average $C_{15}$ to $C_{21}$, generally obtained as a by-product in the production of the propylene tetramer.

Such an alkylation reaction can be carried out in two ways:

- either in a single alkylation reactor, where a large molar excess of aromatic carbide is used with respect to the olefin, routinely up to 10/1 and, after distillation of the aromatic carbide and the unreacted olefin and the alkylates whereof the alkyl portion comprises less than 13 carbon atoms or less, a heavy mono or poly alkyl aryl product is obtained, which can be directly sulfonated and converted to the sulfonate, or in two reactors in series, where, in the first, a slight molar excess of aromatic carbide is used with respect to the olefin, at most 1.5, and, in the second, a larger excess of at least 2, and preferably 5, with the aim of increasing the molecular weight of the alkylates, and which results in a complex mixture of heavy mono alkyl aromatics and poly alkyl aromatics, due to the fragmentation and oligo-polymerization of the branched olefin used in the alkylation reaction.

The branched mono or poly alkyl benzenes can also be heavy by-products obtained in the production of dodecyl benzene, marketed under the name of BAB, which is the abbreviation corresponding to 'Branched Alkyl Benzene'. During the production of this product, a large molar excess of benzene is alkylated by polypropylene tetramer and the heavy by-product is the one that remains at the bottom of the column during the distillation of dodecyl benzene at the top. This heavy by-product is essentially composed of a heavy mono alkyl benzene wherein the number of carbon atoms in the branched alkyl chain is at least 13, and of para and meta dialkyl benzenes. By way of information, the molecular weight of dodecyl benzene is 242, whereas the molecular weight of the heavy by-product, obtained during its production, can range between 300 and 390.

The different alkylation reactions described hereinabove are effected conventionally with Friedel and Craft catalysts, such as HF and $AlCl_3$, for example.

METHODS FOR PREPARING MIXTURES OF ALKYL ARYL SULFONATES

A further aim of the invention is methods for preparing such a mixture of alkyl aryl sulfonates.

A first method of the invention comprises the mixing of the corresponding alkyl aryl hydrocarbons, the sulfonation of this mixture, and the reaction of the resulting sulfonic acids with excess of alkaline earth base.

A second method of the invention comprises the separate preparation of each of the two alkyl aryl sulfonic acids, their mixing and their reaction with an excess of alkaline earth base.

A third method of the invention consists of separately preparing each of the alkyl aryl sulfonates used in the composition of the mixtures and their mixing in the requisite proportions.

The first method is preferred because the sulfonates obtained exhibit better solubility in lubricating oil than the sulfonates obtained by the other two methods.

To prepare the first alkyl phenyl sulfonate which is used in preponderant proportions in the mixtures of the invention, benzene is first alkylated by a linear olefin according to the Friedel and Craft reaction.

This alkylation reaction can be effected either directly with a linear mono olefin, already isomerized, containing a molar proportion between 0 and 13%, preferably between 5 and 11%, and more particularly between 7 and 10% of alpha olefin.

It can also be effected, if one starts with a linear alpha olefin which is not first isomerized, that is containing a conventional molar proportion of about 80% of alpha olefin, by splitting the alkylation reaction into two steps, that is a first step wherein the molar ratio between the benzene and the linear mono olefin is a maximum of 1.5 and preferably 1, and a second step, wherein said ratio is at least 2 and preferably 5.

In either of the alkylation methods according to the Friedel and Craft reaction, an alkyl phenyl hydrocarbon is obtained, exhibiting the desired molar proportion of phenylated isomers in position 1 or 2 of the linear alkyl chain.

The catalyst used for the Friedel and Craft reaction is preferably selected from hydrofluoric acid, aluminum chloride, boron fluoride, a sulfonic ion exchange resin, and an acid-activated clay.

The conditions of this alkylation reaction depend on the type of Friedel and Craft catalyst used.

If the catalyst is hydrofluoric acid, the temperature is preferably between 20 and 70° C. and the pressure between atmospheric pressure and $10\times10^5$ Pa.

If the catalyst is aluminum chloride or boron fluoride, these conditions are the ones described in the literature concerning this reaction.

Finally, if a solid Friedel and Craft catalyst is used, such as a sulfonic ion exchange resin or an acid-activated clay, the temperature of the alkylation reaction is between 40 and 250° C., and the pressure is between atmospheric pressure and $15\times10^5$ Pa.

Although the Applicant does not wish to be bound by any specific explanation, it would appear that the maintenance, at the onset of the alkylation reaction, of a molar ratio of benzene to linear mono alpha olefin of a maximum of 1.5 and preferably 1, in the presence of a Friedel and Craft catalyst, causes the migration of the double bond of the linear olefin from the terminal alpha position to a more central position of the olefin, where the phenyl radical is fixed.

It is presumed that the alpha olefin reactors with the Friedel and Craft catalyst to form an intermediate carbonium ion, which is isomerized, even more easily if the relative proportion of alpha olefin is higher.

The alkylation of this carbonium ion takes place by an aromatic electrophilic substitution reaction, wherein a hydrogen atom of the benzene is substituted by a carbon atom from the linear olefinic chain.

This isomerization reaction is unexpected because, heretofore, the alkylation reaction, which is highly exothermic, was always effected with a large molar excess of benzene with respect to the initial linear olefin.

However, it must be observed that this first isomerization step must be followed by a second step, during which the molar proportion of benzene is 2 and preferably 5 times greater than that of the initial linear olefin, for the purpose of decreasing the proportion of unreacted olefin and accordingly increasing the conversion rate of the initial linear olefin to the alkylate up to a rate close to 100%.

In connection with the present description, the term 'radical' or 'linear alkyl substituent' or 'linear olefin' means a radical or an olefin or a mixture of radicals or straight-chain olefins, which can be obtained by oligo-polymerization of ethylene, and which contain between 14 and 40, preferably between 16 and 30, and more particularly between 20 and 24 carbon atoms, and wherein the molar proportion of mono alpha olefin is at least 80%.

Specific examples of linear olefins answering to this definition are provided by $C_{16}$ and $C_{18}$ olefins, $C_{14}$ to $C_{16}$, $C_{14}$ to $C_{18}$ and $C_{20}$ to $C_{24}$ olefin cuts, or by combinations of a plurality of these.

The $C_{14}$ to $C_{40}$ linear mono alpha olefins which can be obtained by direct oligo-polymerization of ethylene, have an infrared absorption spectrum which exhibits an absorption peak at 908 $cm^{-1}$, characteristic of the presence of an ethylene double bond at the end of the chain, on the carbon atoms occupying positions 1 and 2 of the olefin: also distinguished therein are two other absorption peaks at wavelengths of 991 and 1641 $cm^{-1}$.

By contrast, the isomerized C14 to C40 linear mono olefins, that is wherein the molar proportion of alpha olefin is between 0 and 13%, preferably between 5 and 11%, and more particularly between 7 and 10%, have an infrared absorption spectrum which exhibits no significant peak in the regions of 908, 991 and 1641 $cm^{-1}$, but which, on the contrary, display the appearance of an absorption peak at 966 $cm^{-1}$, characteristic of trans internal ethylene double bond.

These isomerized mono olefins can be obtained by the heating, under atmospheric pressure and at a temperature of about 120° C. for a period of 144 hours, of a cut of $C_{20}$ to $C_{24}$ alpha mono olefins, obtained by the polymerization of ethylene, on a catalyst based on iron pentacarbonyl, for example as described in U.S. Pat. No. 5,320,762.

The aromatic hydrocarbon with which these linear olefins are reacted is exclusively benzene, to the exclusion of any other benzene hydrocarbon, particularly to the exclusion of any alkyl derivative of benzene wherein the aromatic ring is substituted by one or two $C_1$ to $C_5$ alkyl radicals.

The alkylation reaction according to the Friedel and Craft reaction to obtain the alkyl phenyl hydrocarbon corresponding to the first sulfonate of the mixture of the present invention can be effected in two steps, as described hereinabove, by a continuous reaction in two successive reactors in the presence of the catalyst.

In the first reactor, the molar proportion of benzene with respect to the linear olefin is a maximum of 1.5, and preferably 1.2, and more particularly 1, to slow down the alkylation reaction and to promote the isomerization of the initial linear mono alpha olefin by migration of its double bond to the middle of the hydrocarbon chain of the olefin.

In the second reactor, the molar proportion of benzene with respect to the linear mono alpha olefin is increased to at least 2/1, and preferably 5/1 or more, to complete the alkylation reaction.

On completion of the successful passage through the two reactors, the Friedel and Craft catalyst is collected by phase separation, and the excess benzene is recovered by distillation, as in the methods of the prior art.

The same alkyl phenyl hydrocarbon can also be obtained by separately effecting the isomerization of the initial alpha olefin and then by adding the benzene to effect the catalytic alkylation reaction, using a Friedel and Craft catalyst.

The alkylation reaction according to the Friedel and Craft reaction to obtain the heavy alkyl aryl hydrocarbon corresponding to the second sulfonate of the mixture of the present invention is either a dialkyl aryl obtained by the recovery at the bottom of the column of products of the reaction of an aromatic hydrocarbon with a linear mono alpha olefin wherein the sum of the carbon atoms of the two mono alkyl substituents is between 16 and 40, and preferably between 18 and 40 carbon atoms, or a mono or poly alkyl aryl recovered at the bottom of the column, during the distillation of the alkylation reaction products of an aromatic hydrocarbon with a branched olefin wherein the sum of the carbon atoms present in the different branched alkyl substituents is on average at least 15 carbon atoms.

The next step of the sulfonation of each of the alkyl aromatic hydrocarbons or of the mixture of the different alkyl aromatic hydrocarbons corresponding to the mixture of the invention is effected by methods known in themselves, for example by reacting the product of the alkylation step, with concentrated sulfuric acid, with an oleum, with sulfur trioxide dilute in nitrogen or air, or with sulfur trioxide dissolved in sulfur dioxide. This sulfonation reaction can also be effected by contacting the ingredients (alkylate and sulfur trioxide) in the form of a falling film in streams of the same or opposite directions. After sulfonation, the acid or the different sulfonic acids obtained can be purified by conventional methods, such as washing with water or by thermal treatment with stirring by nitrogen bubbling (see, for example, the method described in French patent No.93 11709 to the Applicant).

The next step of the sulfonic acid or acids with an excess of alkaline earth base can be effected by the addition of an oxide or a hydroxide of alkaline earth metal, such as magnesium, calcium, barium, and particularly lime.

This neutralization step is carried out in a dilution oil with an alcohol with a boiling point higher than 80° C. and preferably with a carboxylic acid containing 1 to 4 carbon atoms, in the presence of water, as described in particular in aforementioned French Patent Application No.2.564.830.

Among the alcohols with boiling points higher than 80° C., linear or branched aliphatic mono alcohols are preferably selected, containing 4 to 10 carbon atoms, such as isobutanol, 2-ethyl hexanol and $C_8$ to $C_{10}$ oxo alcohols.

Among the carboxylic acids which can be used are preferably formic acid, acetic acid and their mixtures.

Among the dilution oils which are suitable for the neutralization step, are the paraffinic oils such as 100 Neutral oil, as well as naphthenic or mixed oils.

After the water and alcohol are removed, the solid matter is removed by filtration, and the alkyl aryl sulfonate or sulfonates of alkaline earth metal obtained are collected.

If the corresponding alkyl aryl hydrocarbons or the corresponding sulfonic acids have not already been mixed, the alkyl aryl sulfonates can be mixed at this stage to obtain the mixtures of the invention in the desired proportions.

The mixtures of alkyl aryl sulfonates of the invention are preferably weakly superalkalinized, that is their base No. BN, measured according to Standard ASTM-D-2896, can range from 3 to 60, and they can be used in particular as detergent/dispersant agents for lubricating oils.

The mixtures of alkyl aryl sulfonates of the invention are particularly advantageous if their base No. is low and corresponds to a range of BN between 10 and 40.

It should be observed that this is the first time that it is possible to use alkyl phenyl sulfonates having such a base No., that is between 3 and 60, and preferably between 10 and 40, and obtained exclusively by the alkylation of benzene, as detergent/dispersant additives for lubricating oil exhibiting satisfactory properties, and without the need to add calcium chloride or ammonium chloride to lower the viscosity.

In particular, the mixtures of alkyl aryl sulfonates of the present invention, wherein the proportion of (linear) mono alkyl phenyl sulfonate (constituent (a) defined hereinabove) is between 50 and 75% by weight, require no addition of chloride ions, particularly in the form of calcium chloride or ammonium chloride, to satisfy all the properties hereinabove listed, to serve as detergent/dispersant additives for lubricating oils.

This is not the case of the same mixtures containing 75 to 85% by weight of said (linear) mono alkyl phenyl sulfonate, for which it is preferable to add chloride ions.

In fact, heretofore, only alkyl aryl sulfonates derived from the alkylation of aryl hydrocarbons other than benzene or alkyl aryl sulfonates derived from alkylation by branched olefins were considered as necessary to exhibit all the properties making them suitable as detergent/dispersant additives for lubricating oil.

The mixture of alkyl aryl sulfonates of the invention can be added to the lubricating oils in proportions ranging from 1 to 15% by weight depending on the nature of the lubricating oil.

For example, for a gasoline engine oil, up to 1.7% by weight can be added, for a diesel engine oil or marine engine oil, up to 3.5% by weight can be added, and for a protection oil for a new car, up to 11.5% by weight can be added.

The lubricating oils to which the mixtures of the present invention can be added can be lubricating oils with a naphthenic, paraffinic or mixed base. They can consist of mineral oils or may be derived from coal distillation products, or they may consist of synthetic oils, such as polymers of alkylenes or esters of inorganic acids or carboxylic acids.

EXAMPLES

The invention will be further illustrated by following examples, which set forth particularly advantageous method embodiments. While the Examples are provided to illustrate the present invention, they are not intended to limit it.

These examples contain a number of test results, obtained by the following methods of measurements.

VISCOSITY AT 100° C. IN CST

The viscosity is measured at the temperature of 100° C. after dilution of the product sample to be measured in 100 N oil, until a solution is obtained having a total calcium content of 2.35% by weight. If the product to be measured has a total calcium content lower than 2.35% by weight, the viscosity is measured without dilution, following method ASTM D-445.

COMPATIBILITY

This method is aimed to evaluate the appearance and the storage stability of the additives and the corresponding oils containing them.

This method is applicable to additives for lubricants.

An additive is prepared based on mono-succinimide and zinc dithiophosphate, and containing about 75% by weight of the mixture of sulfonates to be tested, an additive which is placed in a 350 Neutral oil base stock. The appearance of the solution is examined after 30 days at ambient temperature.

The appearance of the product is evaluated before and after storage, and the results are qualified as 'GOOD' or 'POOR' according to whether or not a single phase is maintained without any deposition by sedimentation.

DISPERSION (SPOT TEST)

This method is aimed to evaluate the dispersive properties of an oil or of an additive, and to predict its performance level (deposits, sludge) in comparison with a reference oil.

It is generally applicable to land and marine engine oils.

According to this method, the dispersive power of the oil is obtained by carrying out a paper chromatography of a mixture of oil to be tested and of artificial sludge in the following conditions.

Spot No. 1: ambient temperature under water.

Spot No. 2: 10 minutes at 200° C. under water.

Spot No. 3: 10 minutes at 250° C. under water.

Spot No. 4: ambient temperature with water.

Spot No. 5: 1 minutes at 200° C. with water.

Spot No. 6: 10 minutes at 200° C. with water.

The spots are observed after 48 hours of rest, manually or using the CCD photometer.

On each spot, a measurement is taken of the diameter (d) of diffusion of the mixture and the diameter (D) of diffusion of the oil alone and the ratio d/D×100 is calculated.

The dispersive power of the oil is determined by comparing the sum of the six spots to the value found on one of the reference oils that must be tested in the same series of measurements.

The addition of the ratios d/D×100 in the six conditions herein above listed corresponds to a maximum dispersive power of 600, corresponding to an ideal dispersion of 100% in all conditions. In the results of this test, the higher the figure, the better the dispersant power of the oil.

Examples 1 to 10

(a) Synthesis of the alkylate

The alkylate is synthesized in an alkylation pilot plant with hydrofluoric acid, which consists of two reactors in series of 1.126 liters each, and a 15 liter settler wherein the organic phase is separated from the phase containing the hydrofluoric acid, all of the equipment being maintained under a pressure of about $4\times10^5$ Pa.

The organic phase is then withdrawn via a valve, and expanded to atmospheric pressure, and the benzene is removed by topping, that is heating to 160° C. at atmospheric pressure.

After withdrawal, the mineral phase is neutralized by caustic potash.

The variables of the alkylation reaction are as follows.

Reaction carried out in one or two reactors:

if only one reactor is used, the benzene/olefin mole ratio is 10, which is very high, and the second reactor is by-passed, if two reactors are used, the benzene/olefin mole ratio is relatively low in the first reactor, about 1 to 1.5, and it is higher in the second reactor, about 2 to 10: furthermore, the ratio of hydrofluoric acid to the olefin by volume is 1 in the first reactor and 2 in the second.

(b) Distillation of the alkylate

If benzene is alkylated by a $C_{20}$ to $C_{24}$ linear olefin, there is no formation of a light fraction, that is of alkyl benzene, wherein the alkyl radical is lower than $C_{13}$. Hence it is sufficient to effect a topping of the unreacted benzene to obtain the corresponding alkylate.

In all other cases, a light fraction is produced during the catalytic alkylation reaction, and this light fraction must be removed, just like the excess benzene, on a vacuum distillation column. Light fraction means any alkyl benzene having an alkyl chain lower than $C_{13}$. To remove such a light fraction, the final distillation conditions are as follows:

temperature at top of column: 262° C., temperature at bottom of column: 302° C., pressure: $187\times10^2$ Pa (187 mbar).

(c) Sulfonation of the alkylate

Sulfonation is effected directly on the mixture of the two alkylates of the present invention, wherein the molar proportion of the phenyl radical substituted on the carbon atoms in position 1 or 2 of the alkyl radical is determined with respect to the overall mixture of alkylates subjected to the sulfonation reaction.

This reaction is effected using sulfur trioxide $SO_3$, produced by the passage of a mixture of oxygen and sulfur dioxide $SO_2$ through a catalytic furnace containing vanadium oxide $V_2O_5$.

The gas thus produced is introduced at the top of a sulfonation reactor 2 m long and 1 cm in diameter, in a concurrent alkylate stream.

The resulting sulfonic acid is recovered at the bottom of the reactor. The sulfonation conditions are as follows:

$SO_3$ flow rate set at 76 grams/hour, alkylate flow rate between 350 and 450 grams/hour, depending on the desired $SO_3$/alkylate mole ratio which varies from 0.8 to 1.2, sulfonation temperature between 50 and 60° C., and with nitrogen as vector gas to dilute the $SO_3$ to 4% by volume.

After the sulfonation reaction, the residual sulfuric acid is removed by thermal treatment after dilution by 10% 100 N oil, nitrogen bubbling at the rate of 10 I/h per kg of product, and stirring at 85° C., until a lower residual $H_2SO_4$ content is obtained (maximum 0.5% by weight).

The analyses given in the table below relative to the embodiments of the present invention correspond to the product obtained after thermal treatment.

(d) Superalkalinization

In this step, relative molar proportions of $Ca(OH)_2$ and sulfonic acid obtained in the preceding step are reacted, in order to obtain a proportion of 37% of lime non-neutralized by sulfonic acid in the final product. This proportion of 37% of non-neutralized lime makes it possible to obtain a BN of about 20 in the final sulfonate, according to Standard ASTM D-2.896.

To achieve this, a quantity of $Ca(OH)_2$ is added which does not correspond to the stoichiometric neutralization of the quantity of sulfonic acid reacted, that is 0.5 mol of $Ca(OH)_2$ per mole of this sulfonic acid, but an excess of $Ca(OH)_2$ is added with respect to this stoichiometric quantity, that is a proportion of 0.73 mol of $Ca(OH)_2$ per mole of sulfonic acid, to obtain a BN of about 20.

The conditions of the superalkalinization reaction used are those described in aforementioned French Patent Application No.2,564,830 of the company Orogil, the former name of the Applicant, and published on Nov. 29, 1985.

The performance obtained with the alkyl aryl sulfonate mixtures of the invention are summarized in the table given at the end of the present specification.

Example 1

In this example, 80% by weight of a linear alkylate obtained by the alkylation of benzene by a $C_{20}$ to $C_{24}$ normal alpha olefin, which is hereinafter called the reference linear product, is mixed with 20% by weight of a heavy branched alkylate, also called "LAB Bottom," obtained by the alkylation of benzene by the tetramer of propylene, and the removal of the light aromatic fractions (with alkyl chains lower than $C_{13}$).

Sulfonation is effected on the aforementioned mixture of alkylates.

Example 2

80% by weight of reference linear alkylate is mixed with 20% of a heavy alkylate of the linear phenyl dialkyl type obtained as follows.

In a first alkylation reactor, benzene is reacted with a composition of C8 linear alpha olefins, in a benzene/olefin molar ratio of 1 and an HF/olefin volume ratio of 1, at a temperature of 45° C. and a pressure of $4\times10^5$ Pa. At the exit of this first reactor, a phenyl hydrocarbon substituted by a single $C_8$ alkyl radical is principally obtained, which serves as the aryl hydrocarbon to be alkylated in the next reactor.

Said $C_8$-substituted mono alkyl phenyl hydrocarbon is transferred to a second alkylation reactor where the same quantity of HF is introduced as in the first reactor as well as $C_{18}$ linear alpha olefin in the molar proportion of 3 mole of said substituted phenyl hydrocarbon for 1 mole of $C_{18}$ linear alpha olefin.

After topping the unreacted benzene, all the alkyl phenyl products are distilled, in which the sum of the atoms present in the alkyl chain or chains amounts to 18 carbon atoms inclusive. A product is collected at the column bottom, which is principally a linear phenyl dialkyl wherein one of the alkyl substituents is $C_8$ and the second is C18.

Sulfonation is effected on the aforementioned mixture of alkylates.

Example 3

80% by weight of reference linear alkylate is mixed with 20% by weight of a branched heavy alkylate obtained as follows.

In a first reactor, benzene is catalytically alkylated by propylene tetramer with a benzene/propylene tetramer mole ratio of 1.2 and an HF/propylene tetramer ratio of 1 by volume.

The product thereby obtained is transferred to a second reactor to which hydrofluoric acid and benzene are added in the following proportions:

aromatic/propylene tetramer: 5.8 in mol,

HF/propylene tetramer: 1 in volume.

The benzene and alkylates wherein the length of the branched alkyl chain is lower than or equal to $C_{12}$ are removed by distillation.

Sulfonation is effected on the mixture of alkylates comprising, as herein above described, 80% of reference linear alkylate and 20% of said branched heavy alkylate thereby prepared.

Example 4

Sulfonation is effected on the following mixture of alkylates:

80% by weight of reference linear alkylate, and 20% by weight of branched alkylate derived from the catalytic alkylation reaction of benzene with an average $C_{15}$ to $C_{18}$ olefinic composition, obtained in the production of propylene tetramer with a single reactor, after topping the benzene and removal by distillation of the light fractions corresponding to an alkyl chain lower than $C_{13}$.

Example 5

Sulfonation is effected on the following mixture of alkylates:

80% by weight of reference linear alkylate, and 20% by weight of branched alkylate derived from the catalytic alkylation reaction of benzene with an average $C_{17}$ to $C_{18}$ olefinic composition, obtained in the production of propylene tetramer with two alkylation reactors in series, whereof the alkylation conditions are given in the table below.

In comparison with EXAMPLE 4, two differences exist, intended to promote the increase of the molecular weight: the first is a longer aliphatic chain, $C_{17}$ to $C_{18}$ instead of $C_{15}$ to $C_{18}$ of EXAMPLE 4, and the second is a molar excess of benzene with respect to the branched olefin that is lower than in EXAMPLE 4, that is close to stoichiometry 1.5, in a first reactor to promote, as much as possible, the dimerization of the olefin, either by the formation of two alkyl substituents in the meta or para position, or by alkylation of the dimer on the benzene. This alkylation reaction in the first reactor is followed by a reaction in a second reactor with a very large molar excess of benzene with respect to the olefin, 10, to complete the alkylation of the aromatic carbide in question.

Example 6

This example is identical to the preceding example except for the fact that the 20% by weight of branched alkylate with an average $C_{17}$ to $C_{18}$ olefin have been obtained with a single catalytic alkylation reactor and a molar ratio of 10 of the benzene to this olefin.

Example 7

This example of the invention is identical to EXAMPLE 5, from which it differs in that the proportions of the alkylate mixture are 50/50% instead of 80/20%, as well as the absence of any addition of chloride ions to the corresponding mixture of sulfonates.

Example 8

In this example of the invention, a mixture of 50% of reference linear alkylate and 50% of an alkylate obtained by the alkylation of benzene with a $C_{12}$ linear olefin is used, in a single reactor with topping of the benzene and removal of the alkyl phenyl hydrocarbons substituted by a single $C_{12}$ alkyl radical, and the corresponding mixture of sulfonates is analyzed without the addition of chloride ions.

Example 9

This example only differs from EXAMPLE 7 by the addition of chloride ions in the form of calcium chloride.

The results of the tests performed on the corresponding mixtures of sulfonates reveal a compatibility of this mixture in a lubricating oil at the limit of the acceptable, because a slight turbidity appears during the mixing with the lubricating oil.

This EXAMPLE 9 demonstrates the advantage of avoiding any addition of chloride ions to the mixtures of sulfonates of the invention, comprising between 50 and 75% of linear mono alkyl phenyl sulfonate (a) and between 25 and 50% of a heavy alkyl aryl sulfonate (b), as herein before defined.

Comparative Example 10

In this example, a single alkylate has been sulfonated, that is the heavy alkylate of the linear phenyl dialkyl type of EXAMPLE 2.

The alkylation yield is found to be lower and the sulfonate rate has practically decreased by half, and the $H_2SO_3$ content of the sulfonic acid obtained falls from 14.4% in EXAMPLE 2 to 8.5% in EXAMPLE 10.

Comparative Example 11

In this example, the sulfonation is effected exclusively on the heavy branched alkylate corresponding to the one used in EXAMPLE 5 of the invention.

Comparative Example 12

In this example outside the invention, sulfonation is effected exclusively on the heavy branched alkylate described in EXAMPLE 6 of the invention.

Comparative Example 13

In this example, alkylation is effected exclusively on the reference linear alkylate, used at the rate of 80% by weight in the embodiments 1 to 6 of the present invention.

It may be recalled that, during the preparation of this alkylate, two catalytic alkylation reactions are used in succession:

- a first reactor wherein the molar ratio of benzene to $C_{20}$ to $C_{24}$ linear olefin is maintained at 1.2 to slow down the alkylation reaction in order to promote the migration of the double bond of the olefin from the ends to the interior of the chain before alkylation, and thereby to obtain a minimum 1- or 2-phenyl isomer content conforming to the present invention, and wherein the volume ratio of hydrofluoric acid to the olefin is 1, and
- a second reactor wherein a large excess of benzene is added with respect to the olefin, and wherein hydrofluoric acid is added to obtain a benzene/olefin mole ratio of 5.8 and an HF/olefin volume ratio of 2.

Comparative Example 14

In this example, the sulfonation is effected exclusively on the C15 to C18 heavy branched alkylate used in EXAMPLE 4, in order to determine the influence of the molecular weight.

It may be observed that, as in comparative EXAMPLE 13, the corresponding sulfonate exhibits a superficial skin which makes it unfit for use as an additive for lubricating oil.

Comparative Example 15

This is the same as comparative EXAMPLE 13 except that a single alkylation reactor is used with a benzene/olefin ratio of 10, which results in an alkylate wherein the mole ratio of the phenyl substituents in positions 1 and 2 to the total phenyl substituents irrespective of position is 0.20 instead of 0.093.

The consequences on the corresponding sulfonate are a smaller incorporation of lime (BN 14.5 instead of 19.4), a higher viscosity, a lower filtration rate, and, above all, a quicker appearance of skin with gel formation and poor compatibility, making it unfit as an additive for lubricants.

Comparative Example 16

An attempt was made to use the 80/20 mixture of alkylates containing 80%, not of the reference alkylate used in EXAMPLES 1 to 9 of the invention, but an alkylate obtained with a single alkylation reactor, wherein the benzene/$C_{20}$ to $C_{24}$ linear olefin ratio is 10, first resulting in an alkylate having a molar content of 0.20 of substituent in positions 1 and 2. This content, which is lowered to 0.16 in the 80/20 mixture with 20% of a heavy alkylate, proved to yield good results according to EXAMPLE 5, but did not pass the tests satisfactorily, as shown in particular by the formation of a gel and a superficial skin after one day, and poor compatibility with the lubricating oil.

Dispersion tests, performed according to the spot test, as herein above defined, yielded the following results.

| dispersion | | | | |
|---|---|---|---|---|
| | alkylate composition | | | |
| Example | benzene/ $C_{20}$ to $C_{24}$ | benzene/ $C_{17}$ to $C_{18}$ propylene tetramer derivative | spot test on corresponding sulfonates | foaming ASTM D-892 Sequence 1 |
| 13 | 100% | — | 372 | 0/0 |
| 5 | 80% | 20% | 369 | 0/0 |
| 9 | 50% | 50% | 366 | 0/0 |
| 11 | — | 100% | 337 | 270/60 |

It appears from these data that the dispersion is better with a chemical mixture of the sulfonates of the invention than with a physical mixture of each of the individual sulfonates in the same proportions.

Foaming tests were also carried out following the standard method of ASTM D-892, Sequence 1, wherein the better the figure the better the product.

The results of these tests, which are given above concerning EXAMPLES 5 and 9 of the invention and the comparative EXAMPLES 11 and 13, confirm that, at excessively high contents of branched alkyl benzene (EXAMPLE 11), excessive foaming makes the sulfonate unacceptable as an additive for lubricants, and, on the contrary, at the contents of the invention (EXAMPLES 5 and 9) the sulfonates do not foam.

TABLE

| TEST NO. | 1 | | 2 | | 3 | | 4 | | 5 | |
|---|---|---|---|---|---|---|---|---|---|---|
| ALKYLATION | | | | | | | | | | |
| Aromatic | Benzene | Benzene | Benzene | Benzene | Benzene | Benzene | Benzene | Benzene | Benzene | Benzene |
| Linear olefin | $C_{20-24}$ | | $C_{20-24}$ | $C_8/C_{18}$ | $C_{20-24}$ | | $C_{20-24}$ | C2#24 | | |
| Propylene tetramer derivative | | $C_{12}$ | | | | $C_{12}$ | | $C_{15-18}$ | | $C_{17-18}$ |
| ALKYLATION CONDITIONS | | | | | | | | | | |
| Catalyst | HF | HF | HF | HF | HF | HF | HF | HF | HF | HF |
| REACTOR 1 | | | | | | | | | | |
| Aromatic/olefin (mol) | 1.2 | .10 | 1.2 | 1 | 1.2 | 1.2 | 1.2 | 10 | 1.2 | 1.5 |
| REACTOR 2 | | | | | | | | | | |
| Total aromatic/olefin (mol) | 5.8 | | 5.8 | 3 | 5.8 | 5.8 | 5.8 | | 5.8 | 10 |
| CONDITIONS FOR OBTAINING ALKYLATE | Benzene topping | Bz + lights removal | Benzene topping | Bz + lights removal | Benzene topping | Bz + lights removal | Benzene topping | Bz + lights removal | Benzene topping | Bz + lights removal |
| ANALYSIS OF ALKYLATE | | | | | | | | | | |
| position 1 + 2 (mol) / 3 positions | 0.093 | | 0.093 | | 0.093 | | 0.093 | | 0.093 | |
| Viscosity at 40° C. (cSt) | 17 | 35 | 17 | 25 | 17 | 16.5 | 17 | 17 | 17 | 49 |
| % weight of alkylate | 80 | 20 | 80 | 20 | 80 | 20 | 80 | 20 | 80 | 20 |
| CHARACTERISTICS OF CORRESPONDING MIXTURE OF ALKYLATES, ACIDS AND SULPHONATES | | | | | | | | | | |
| ANALYSIS OF ALKYLATE | | | | | | | | | | |
| position 1 + 2(mol) / 3 positions for the 2 alkylates | 0.074 | | 0.074 | | 0.074 | | 0.074 | | 0.074 | |
| ANALYSIS OF THE ACID | | | | | | | | | | |
| % $HSO_3$ (weight) | 12.8 | | 14.4 | | 15.3 | | 15.8 | | 14.5 | |
| % $H_2SO_4$ (weight) | 0.2 | | 0.3 | | 0.27 | | 0.24 | | 0.17 | |
| ANALYSIS OF THE SULPHONATE | | | | | | | | | | |
| With or without $CaCl_2$ | WITH | | WITH | | WITH | | WITH | | WITH | |
| % CaT (weight) | 2.35 | | 2.6 | | 2.63 | | 2.56 | | 2.56 | |
| % CaS (weight) | 1.6 | | 1.76 | | 1.74 | | 1.8 | | 1.89 | |
| BN (D2896) | 17 | | 19.8 | | 19.7 | | 17.7 | | 17.9 | |
| Viscosity at 100° C. with 2.35 Ca (cSt) | 30 | | 18.4 | | 21.8 | | 80 | | 36 | |
| % crude sediment (vol) | 0.6 | | 0.4 | | 0.6 | | 0.6 | | 0.6 | |
| Filtration rate (kg/H/m$^2$) | 1200 | | 3350 | | 240 | | 480 | | 790 | |
| Skin formation in open air | 5 days | | 7 days | | 1 month | | 1 month | | 7 days | |
| Compatibility | GOOD | | GOOD | | GOOD | | GOOD | | GOOD | |

TABLE-continued

| TEST NO. | 6 | | 7 | | 8 | | 9 | |
|---|---|---|---|---|---|---|---|---|
| ALKYLATION | | | | | | | | |
| Aromatic | Benzene | Benzene | Benzene | Benzene | Benzene | Benzene | Benzene | Benzene |
| Linear olefin | $C_{20-24}$ | | $C_{20-24}$ | | $C_{20-24}$ | $C_{12}$ | $C_{20-24}$ | |
| Propylene tetramer derivative | | $C_{17-18}$ | | $C_{17-18}$ | | | | $C_{17-18}$ |
| ALKYLATION CONDITIONS | | | | | | | | |
| Catalyst | HF | HF | HF | HF | HF | HF | HF | HF |
| REACTOR 1 | | | | | | | | |
| Aromatic/olefin (mol) | 1.2 | 10 | 1.2 | 1.5 | 1.2 | 10 | 1.2 | 1.5 |
| REACTOR 2 | | | | | | | | |
| Total aromatic/olefin (mol) | 5.8 | | 5.8 | 10 | 5.8 | | 5.8 | 10 |
| CONDITIONS FOR OBTAINING ALKYLATE | Benzene topping | Bz + lights removal | Benzene topping | Bz + lights removal | Benzene topping | Bz + lights removal | Bz + lights removal | Bz + lights removal |
| ANALYSIS OF ALKYLATE | | | | | | | | |
| position 1 + 2 (mol) / 3 positions | 0.093 | | 0.093 | | 0.093 | | 0.093 | |
| Viscosity at 40° C.(cSt) | 17 | 27.5 | 17 | 49 | 17 | | 17 | 16.5 |
| % weight of alkylate | 80 | 20 | 50 | 50 | 50 | 50 | 50 | 50 |
| CHARACTERISTICS OF CORRESPONDING MIXTURE OF ALKYLATES, ACIDS AND SULPHONATES | | | | | | | | |
| ANALYSIS OF ALKYLATE | | | | | | | | |
| position 1 + 2(mol) / 3 positions for the 2 alkylates | 0.074 | | 0.046 | | 0.046 | | 0.046 | |
| ANALYSIS OF THE ACID | | | | | | | | |
| % $HSO_3$ (weight) | 15.2 | | 13.6 | | 13.9 | | 13.9 | |
| % $H_2SO_4$ (weight) | 0.11 | | 0.2 | | 0.2 | | 0.2 | |
| ANALYSIS OF THE SULPHONATE | | | | | | | | |
| With or without $CaCl_2$ | WITH | | WITHOUT | | WITHOUT | | WITH | |
| % CaT (weight) | 2.6 | | 2.42 | | 2.41 | | 2.7 | |
| % CaS (weight) | 1.76 | | 1.61 | | 1.72 | | 1.79 | |
| BN (D2896) | 20 | | 18 | | 17 | | 19 | |
| Viscosity at 100° C. with 2.35 Ca (cSt) | 35.5 | | 27 | | 50 | | 22 | |
| % crude sediment (vol) | 1 | | 0.7 | | 0.6 | | 0.4 | |
| Filtration rate (kg/H/m$^2$) | 1350 | | 600 | | 300 | | 600 | |
| Skin formation in open air | 7 days | | over 1 month | | 2 months | | 1 month | |
| Compatibility | GOOD | | GOOD | | GOOD | | ACCEPTABLE | |

| TEST NO. | 10 | 11 | 12 | 13 | 14 | 15 | 16 | 16 |
|---|---|---|---|---|---|---|---|---|
| ALKYLATION | | | | | | | | |
| Aromatic | Benzene | Benzene | Benzene | Benzene | Benzene | Benzene | Benzene | Benzene |
| Linear olefin | $C_8/C_{18}$ | | | $C_{20-24}$ | | $C_{20-24}$ | $C_{20-24}$ | |
| Propylene tetramer derivative | | $C_{17-18}$ | $C_{17-18}$ | | $C_{15-18}$ | | | $C_{17-18}$ |
| Catalyst | HF | HF | HF | HF | HF | HF | HF | HF |
| REACTOR 1 | | | | | | | | |
| Aromatic/olefin (mol) | 1 | 1.5 | 10 | 1.2 | 10 | 10 | 10 | 1.5 |
| REACTOR 2 | | | | | | | | |
| Total aromatic/olefin (mol) | 3 | 10 | | 5.8 | | | | 10 |
| CONDITIONS FOR OBTAINING ALKYLATE | Bz + lights removal | Bz + lights removal | Bz + lights removal | Benzene topping | Bz + lights removal | Benzene topping | Benzene topping | Bz + lights removal |
| ANALYSIS OF ALKYLATE | | | | | | | | |
| position 1 + 2 (mol) / 3 positions | | | | 0.093 | | 0.20 | 0.2 | |
| Viscosity at 40 ° C. (cSt) | 25 | 49 | 27.5 | 17 | 17 | 18 | 18 | 49 |
| % weight of alkylate | 100 | 100 | 100 | 100 | 100 | 100 | 80 | 20 |
| CHARACTERISTICS OF CORRESPONDING MIXTURE OF ALKYLATES, ACIDS AND SULPHONATES | | | | | | | | |
| ANALYSIS OF ALKYLATE | | | | | | | | |
| position 1 + 2(mol) / 3 positions for the 2 alkylates | | | | 0.093 | | 0.20 | 0.16 | |

TABLE-continued

| ANALYSIS OF THE ACID | | | | | | | |
|---|---|---|---|---|---|---|---|
| % $HSO_3$ (weight) | 8.5 | 10.5 | 15 | 15.4 | 17.3 | 14.6 | 14.2 |
| % $H_2SO_4$ (weight) | 0.3 | 0.35 | 0.1 | 0.18 | 0.1 | 0.2 | 0.2 |
| ANALYSIS OF THE SULPHONATE | | | | | | | |
| With or without $CaCl_2$ | WITH | WITH | WITH | WITH | WITH | WITH | WITH |
| % CaT (weight) | 2.67 | 2.66 | 2.4 | 2.64 | 2.59 | 2.35 | 2.45 |
| % CaS (weight) | 1.74 | 1.78 | 1.74 | 1.83 | 1.76 | 1.75 | 1.71 |
| BN (02896) | 21.9 | 18 | 23 | 19.4 | 19 | 14.5 | 17.2 |
| Viscosity at 100° C. with 2.35 Ca (cSt) | 22 | 30 | 103 | 46.4 | 97 | 100 | 52 |
| % crude sediment (vol) | 0.6 | 0.12 | 0.6 | 0.6 | 0.6 | 1.2 | 0.8 |
| Filtration rate (kg/H/$m^2$) | 15 | 500 | 250 | 710 | 545 | 30 | 208 |
| Skin formation in open air | no skin | 3 days | 3 days | 1 day gel | 1 day | 10 hours | gel 1 day |
| Compatibiiity | POOR | POOR | POOR | POOR | POOR | POOR | POOR |

While the present invention has been described with reference to specific embodiments, this application is intended to cover those various changes and substitutions that may be made by those skilled in the art without departing from the spirit and scope of the appended claims.

What is claimed is:

1. A mixture of alkyl aryl sulfonates of superalkalinized alkaline earth metals characterized in that it comprises (a) at least 50% and not more than 85% by weight of a mono alkyl phenyl sulfonate in which the mono alkyl substituent is a linear chain, containing between 14 and 40 carbon atoms, and the phenyl sulfonate radical of the alkaline earth metal is fixed, in a molar proportion of between 0 and 13%, in position 1 or 2 of the linear alkyl chain, and (b) at least 15% and not more than 50% by weight of a heavy alkyl aryl sulfonate selected from:

(i) dialkyl aryl sulfonates, wherein the two alkyl substituents are both linear alkyl chains, of which the sum of the carbon atoms is between 16 and 40, and (ii) mono or poly alkyl aryl sulfonates wherein the alkyl substituent or substituents are branched chains, wherein the sum of the carbon atoms is on average between at least 15 and up to 48 carbon atoms;

wherein said mixture of alkyl aryl sulfonates has a maximum molar content of 10% of linear mono alkyl phenyl sulfonate having the phenyl sulfonate radical substituted in position 1 or 2 of the linear alkyl chain.

2. A mixture as claimed in claim 1, wherein the linear alkyl chain of the mono alkyl phenyl sulfonate, as defined in (a) of claim 1, contains between 16 and 30 carbon atoms.

3. A mixture as claimed in claim 2, wherein the linear alkyl chain of the mono alkyl phenyl sulfonate, as defined in (a) of claim 1, contains between 20 and 24 carbon atoms.

4. A mixture according to claim 1 wherein the phenyl sulfonate radical of the mono alkyl phenyl sulfonate, as defined in (a) of claim 1, is fixed, in a molar proportion of between 5 and 11%, in position 1 or 2 of the linear alkyl chain.

5. A mixture according to claim 4 wherein the phenyl sulfonate radical of the of the mono alkyl phenyl sulfonate, as defined in (a) of claim 1, is fixed, in a molar proportion of between 7 and 10%, in position 1 or 2 of the linear alkyl chain.

6. A mixture according to claim 1 wherein the aryl radical of the dialkyl aryl sulfonates, as defined in (b)(i) of claim 1, is selected from the group consisting of phenyl, tolyl, xylyl, ethyl phenyl, and cumenyl radicals.

7. A mixture according to claim 1 wherein the sum of the carbon atoms of the dialkyl aryl sulfonates, as defined in (b)(i) of claim 1, is between 18 and 40 carbon atoms.

8. A mixture according to claim 1 wherein the aryl radical of the mono or poly alkyl aryl sulfonates, as defined in (b)(ii) of claim 1, is selected from the group consisting of phenyl, tolyl, xylyl, ethyl phenyl, and cumenyl radicals.

9. A mixture according to claim 1 wherein said mixture of alkyl aryl sulfonates has a maximum molar content of 8% of linear mono alkyl phenyl sulfonate having the phenyl sulfonate radical substituted in position 1 or 2 of the linear alkyl chain.

10. A mixture according to claim 1 wherein said mixture contains between 75 and 85% by weight of mono alkyl phenyl sulfonates such as defined in (a), and between 15 and 25% by weight of the heavy alkyl aryl sulfonate as defined in (b) of said claim 1.

11. A mixture as claimed in claim 1, wherein said mixture contains between 50 and 75% by weight of mono alkyl phenyl sulfonate such as defined in (a), and between 25 and 50% by weight of the heavy alkyl aryl sulfonate as defined in (b) of said claim 1, said mixture being free of chloride ions.

12. A mixture as claimed in claim 1, wherein the base No. BN of said mixture, as measured according to Standard ASTM-D-2896, is between 3 and 60.

13. A mixture as claimed in claim 12, wherein the base No. BN of said mixture, as measured according to Standard ASTM-D-2896, is between 10 and 40.

14. Lubricating oil containing a mixture of alkyl aryl sulfonates of superalkalinized alkaline earth metal as claimed in claim 1.

* * * * *